US010726654B2

(12) United States Patent
Siklosi

(10) Patent No.: US 10,726,654 B2
(45) Date of Patent: Jul. 28, 2020

(54) AUTHENTICATION OF A USER FOR ACCESS TO A PHYSICAL SPACE

(71) Applicant: ASSA ABLOY AB, Stockholm (SE)

(72) Inventor: Peter Siklosi, Taby (SE)

(73) Assignee: ASSA ABLOY AB (SE)

( * ) Notice: Subject to any disclaimer, the term of this patent is extended or adjusted under 35 U.S.C. 154(b) by 0 days.

(21) Appl. No.: 15/535,845

(22) PCT Filed: Dec. 15, 2015

(86) PCT No.: PCT/EP2015/079722
§ 371 (c)(1),
(2) Date: Jun. 14, 2017

(87) PCT Pub. No.: WO2016/096803
PCT Pub. Date: Jun. 23, 2016

(65) Prior Publication Data

US 2017/0352207 A1 Dec. 7, 2017

(30) Foreign Application Priority Data

Dec. 18, 2014 (EP) ..... 14198790

(51) Int. Cl.
*G07C 9/00* (2020.01)
*G07C 9/27* (2020.01)
*G07C 9/28* (2020.01)

(52) U.S. Cl.
CPC ..... *G07C 9/27* (2020.01); *G07C 9/00309* (2013.01); *G07C 9/00571* (2013.01); *G07C 9/28* (2020.01);

(Continued)

(58) Field of Classification Search
CPC ..... G07C 9/00103; G07C 9/00111; G07C 9/00309; G07C 9/00571
See application file for complete search history.

(56) References Cited

U.S. PATENT DOCUMENTS 5,422,634 A * 6/1995 Okubo ..... G07C 9/00031 340/5.24
2003/0117260 A1* 6/2003 Fanshawe ..... G07C 9/00023 340/5.7

(Continued)

FOREIGN PATENT DOCUMENTS

CN 101868810 10/2010
CN 104183041 12/2014

(Continued)

OTHER PUBLICATIONS

International Search Report and Written Opinion prepared by the European Patent Office dated Jan. 26, 2016, for International Application No. PCT/EP2015/079722.

(Continued)

*Primary Examiner* — Nabil H Syed
(74) *Attorney, Agent, or Firm* — Sheridan Ross P.C.

(57) ABSTRACT

It is presented a method performed in a key device for authenticating a user for access to a physical space. The method comprises the steps of: detecting the presence of a lock device; sending a request for authorisation data to an access control server, the request comprising an identifier of the key device; receiving authorisation data from the access control server; determining whether the key device is authorised to open the lock device; and sending an unlock signal to the lock device when the key device is allowed to open the lock device.

10 Claims, 3 Drawing Sheets

(52) U.S. Cl.
CPC ..... *G07C 2009/00769* (2013.01); *G07C 2009/00992* (2013.01)

(56) References Cited

U.S. PATENT DOCUMENTS

| | | | | |
|---|---|---|---|---|
| 2007/0296545 | A1 | 12/2007 | Clare | |
| 2010/0223465 | A1* | 9/2010 | Matsui | G07C 9/00857 713/168 |
| 2012/0213362 | A1 | 8/2012 | Bliding et al. | |
| 2012/0280783 | A1* | 11/2012 | Gerhardt | G07C 9/00309 340/5.6 |

FOREIGN PATENT DOCUMENTS

| | | | |
|---|---|---|---|
| EP | 2085934 | A1 | 8/2009 |
| EP | 2701124 | | 2/2014 |
| WO | WO 2011/159921 | | 12/2011 |

OTHER PUBLICATIONS

International Preliminary Report on Patentability prepared by the European Patent Office dated Oct. 17, 2016, for International Application No. PCT/EP2015/079722.
Second Written Opinion prepared by the European Patent Office dated Nov. 18, 2016, for International Application No. PCT/EP2015/079722.
Official Action with English Translation for China Patent Application No. 201580068600.4, dated Mar. 19, 2019, 21 pages.

* cited by examiner

AUTHENTICATION OF A USER FOR ACCESS TO A PHYSICAL SPACE

CROSS REFERENCE TO RELATED APPLICATIONS

This application is a national stage application under 35 U.S.C. 371 and claims the benefit of PCT Application No. PCT/EP2015/079722 having an international filing date of 15 Dec. 2015, which designated the United States, which PCT application claimed the benefit of European Patent Application No. 14198790.9 filed 18 Dec. 2014, the disclosures of each of which are incorporated herein by reference.

TECHNICAL FIELD

The invention relates to a method, key device, computer program and computer program product for authenticating a user for access to a physical space.

BACKGROUND

Electronic access control systems used for access control of physical spaces increase continuously in popularity. Many different topologies of such systems have evolved, of which one is when electronic lock devices are installed without a power supply. The lock devices may then be powered when a matching key device is inserted, using an electrical connection with the key device.

An issue exists in how lock devices are provided with up-to-date access rights. For example, if a person loses a key device, it should be easy and reliable for an operator of the access control system to bar the lost key device from gaining access to any lock devices of the access control system.

In the prior art, the key devices are updated using dedicated key update devices connected to laptop computers and/or mobile phones. While this can provide updated access rights to the key devices for provision to the lock devices, the key update devices are large and cumbersome, whereby the keys are not updated very often. This leads to compromised security since a significant amount of time can flow from an operator updating access rights and the updated access rights being propagated to all lock devices.

US 2012/0213362 A1 discloses a method of updating lock access data for an electromechanical lock. The lock is of a type capable of being actuated by a user desiring to open the lock with a key having electronic key data stored therein. Updated lock access data for the lock may be configured by an administrator from a remote site and communicated to the lock using public networks. According to the method, updated lock access data from the remote site for the lock is transmitted over a telecommunication channel to a mobile terminal. The updated lock access data is transmitted from the mobile terminal to the key using short-range wireless communication. When the user attempts to open the lock with the key, the updated lock access data as received from the mobile terminal is forwarded from the key to the lock. The lock verifies that the user is trusted and then accepts the updated lock access data as received from the key. However, this solution is cumbersome and requires that updated lock access data to be propagated to all locks to achieve a secure system.

SUMMARY

It is an object to improve security of an access control system with off-line lock devices.

According to a first aspect, it is presented a method performed in a key device for authenticating a user for access to a physical space. The method comprises the steps of: detecting the presence of a lock device; determining whether new authorisation data is mandated from the access control server for determination whether the key device is authorised to open the lock device; sending a request for authorisation data to an access control server, the request comprising an identifier of the key device when new authorisation data is mandated from the access control server; receiving authorisation data from the access control server when new authorisation data is mandated from the access control server; determining whether the key device is authorised to open the lock device; and sending an unlock signal to the lock device when the key device is allowed to open the lock device. This method provides an ability to control when to mandate that a lock device requires access to the access control server for unlocking. In other words, some locks can be configured to mandate online access to allow to be unlocked. This can e.g. be applied for shell protection, e.g. external doors to a building. Moreover, some locks can be configured not to mandate new authorisation data.

In the step of receiving, the authorisation data may comprise an access list indicating one or more lock devices that the key device is authorised to open; and wherein the step of determining whether the key device is authorised is based on the access list.

When new authorisation data is not required from the access control server to determine whether the key device is authorised to open the lock device, the determining whether the key device is authorised to open the lock device may be based on an access list stored in the key device, the access list indicating one or more lock devices that the key device is authorised to open.

In the step of sending a request, the request may comprise an identifier of the lock device.

The method may further comprise the step of: sending transaction data to the access control server comprising an indication of the result of the step of determining whether the key device is authorised.

The step of sending transaction data may be performed prior to the step of sending an unlock signal.

According to a second aspect, it is presented a key device arranged to authenticate a user for access to a physical space. The key device comprises: a processor; and a memory storing instructions that, when executed by the processor, causes the key device to: detect the presence of a lock device; determine whether new authorisation data is mandated from the access control server for determination whether the key device is authorised to open the lock device; send a request for authorisation data to an access control server, the request comprising an identifier of the key device when new authorisation data is mandated from the access control server; receive authorisation data from the access control server when new authorisation data is mandated from the access control server; determine whether the key device is authorised to open the lock device; and send an unlock signal to the lock device when the key device is allowed to open the lock device.

The authorisation data may comprise an access list indicating one or more lock devices that the key device is authorised to open; in which case the instructions to determine whether the key device is authorised comprise instructions that, when executed by the processor, causes the key device to perform the determination based on the access list.

The key device may further comprise instructions that, when executed by the processor, causes the key device to:

when new authorisation data is not required from the access control server to determine whether the key device is authorised to open the lock device, determine whether the key device is authorised to open the lock device based on an access list stored in the key device, the access list indicating one or more lock devices that the key device is authorised to open.

The request may comprise an identifier of the lock device.

The key device may further comprise instructions that, when executed by the processor, causes the key device to: send transaction data to the access control server comprising an indication of the result of the instructions to determine whether the key device is authorised.

The key device may further comprise instructions that, when executed by the processor, causes the key device to perform the instructions to send transaction data prior to the instructions to send an unlock signal.

According to a third aspect, it is presented a computer program for authenticating a user for access to a physical space. The computer program comprises computer program code which, when run on a key device causes the key device to: detect the presence of a lock device; send a request for authorisation data to an access control server, the request comprising an identifier of the key device; receive authorisation data from the access control server; determine whether the key device is authorised to open the lock device; and send an unlock signal to the lock device when the key device is allowed to open the lock device.

According to a fourth aspect, it is presented a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
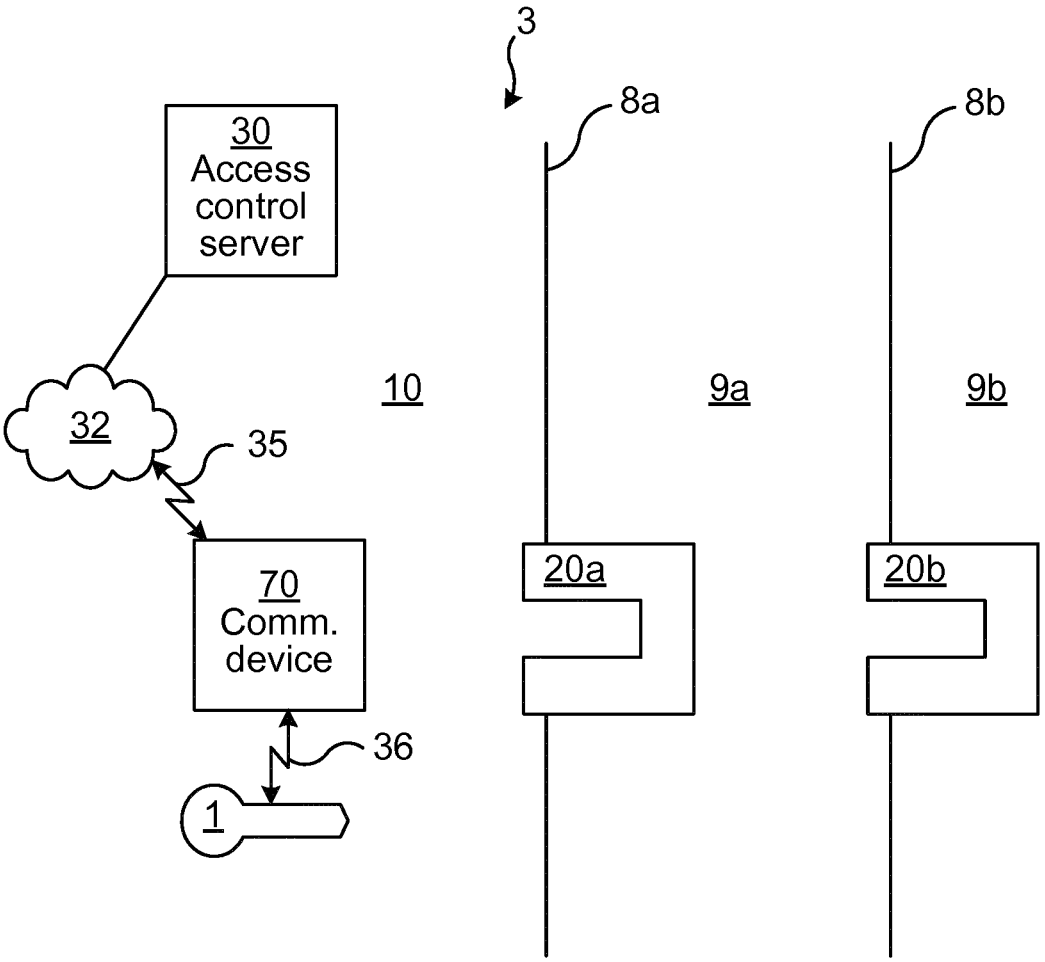
FIG. 1 is a schematic diagram illustrating an access control system in which embodiments presented herein can be applied.

FIG. 1 is a schematic diagram illustrating an access control system 3 in which embodiments presented herein can be applied. There are here three physical spaces 10, 9*a-b*. An outside space 10 is external to access control of this system and can e.g. be outside or in a common space of a building without access control.

Access to a first controlled space 9*a* is controlled using a first lock device 20*a*. Once inside the first controlled space 9*a*, a user can gain access to a second controlled space 9*b* by unlocking a second lock device 20*b*.

The lock devices 20*a-b* are physical lock devices implementing access control in communication with key devices 1 presented to it, e.g. when a key device 1 is inserted in the lock device 20*a-b* in question. In one embodiment, the lock devices 20*a-b* are also powered by an electrical connection (galvanic or inductive) to the key device 1. Also, there is communication between the key device 1 and a respective lock device 20*a-b* when inserted in one of the lock devices 20*a-b*, enabling electronic access control as to whether the key device 1 should be allowed to open the lock device 20*a-b* in question. When access is granted, the lock device in question 20*a-b* is set to an openable state, whereby a user can access the controlled space 9*a-b* in question, e.g. by opening a physical barrier, such as a door, gate, window, etc., which is access controlled by the lock device 20*a-b*.

The key device 1 is equipped with a radio communication module, whereby it can communicate with an access control server 30 of the access control system 3 via a communication device 70. The radio communication module is adapted for a short range radio network (such as Bluetooth, Bluetooth Low Energy (BLE), WiFi, etc.), whereby the key device 1 communicates over a short range radio link 36 with a communication device 70. The communication device 70 communicates in turn over a cellular network link 35 with the cellular network 32. The cellular network 32 can be e.g. any one or a combination of LTE (Long Term Evolution), UMTS (Universal Mobile Telecommunications System) utilising W-CDMA (Wideband Code Division Multiplex), CDMA2000 (Code Division Multiple Access 2000), or any other current or future wireless network, as long as the principles described hereinafter are applicable. In this way, the communication device 70 acts as a gateway, providing access to the access control server 30 for the key device 1 and vice versa. Optionally, the key device 1 and the communication device 70 form part of the same physical device as explained in more detail below.

The access control server 30 acts as a controller in the access control system 3 and may e.g. be implemented using one or more computers. An operator can thereby control access control rights and monitor other security aspects of the access control system using the access control server 30.

Figure 2:
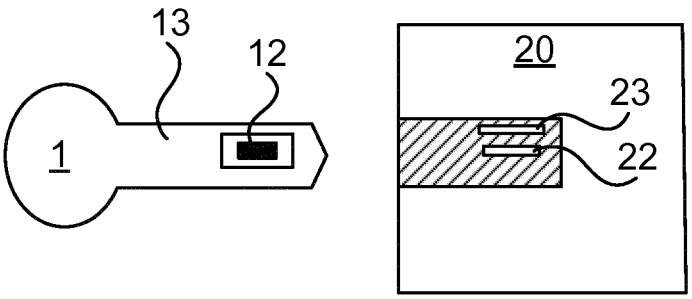
FIG. 2 is a schematic diagram more closely illustrating a key device and a lock device from FIG. 1.

FIG. 2 is a schematic diagram of an embodiment more closely illustrating a key device 1 and one of the lock devices 20*a-b* from FIG. 1, here represented by a single lock device 20.

The key device 1 comprises a connector 12 and a mechanical interface 13 (such as a blade), which are electrically insulated from each other. The lock device 20 comprises a socket with a first connector 22 and a second connector 23. The first connector 22 is positioned such that, when the key device 1 is inserted in the socket, the first connector 22 makes contact with the connector 12 of the key device. The connection can be galvanic, or alternatively an inductive connection. In the case of an inductive connection, the connectors do not need to physically connect. Analogously, the second connector 23 is positioned such that, when the key device 1 is inserted in the socket, the second connector 23 makes galvanic contact with the mechanical interface 13 of the key device 1. This arrangement provides a dual terminal connection between the key device 1 and the lock device 20 when the key device 1 is inserted in the socket of the lock device 20. The dual terminal connection is used both for communication between the key device 1 and the lock device and for powering the lock device by transferring electric power from a power supply of the key device 1 to the lock device 20. Alternatively, separate connectors (not shown) can be provided for powering the lock device 20 and communication between the key device 1 and the lock device 20.

In one embodiment, the key device is implemented using a fob or a mobile phone/smart phone. In such a case, the key device can communicate with the lock device using RF (radio frequency) signals.

Figure 3:
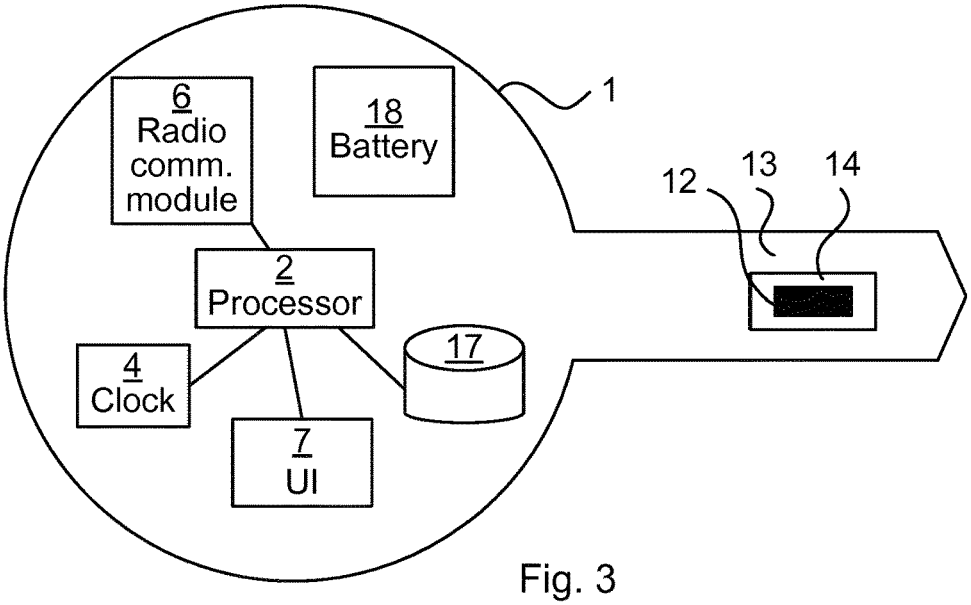
FIG. 3 is a schematic diagram illustrating some components of the key device of FIGS. 1 and 2.

FIG. 3 is a schematic diagram illustrating some components of the key device of FIGS. 1 and 2. A processor 2 is provided using any combination of one or more of a suitable central processing unit (CPU), multiprocessor, microcontroller, digital signal processor (DSP), application specific integrated circuit etc., capable of executing software instructions 66 stored in a memory 17, which can thus be a computer program product. The processor 2 can be configured to execute the method described with reference to FIG. 5 below.

The memory 17 can be any combination of read and write memory (RAM) and read only memory (ROM). The memory 17 also comprises persistent storage, which, for example, can be any single one or combination of solid state memory, magnetic memory, or optical memory. The memory 17 is also used as a data memory for reading and/or storing data during execution of software instructions in the processor 2.

Optionally, the processor 2 and the memory 17 can be provided in a single microcontroller unit (MCU).

The key device 1 also comprises a radio communication module 6. The radio communication module 6 comprises one or more transceivers, comprising analogue and digital components, and a suitable number of antennas. The radio communication module can be provided for communication over short range radio (such as Bluetooth, Bluetooth Low Energy (BLE), WiFi, Near Field Communication (NFC), etc.) with the communication device 70 or even optionally the lock device 20 when the key device 1 and the communication device 70 are part of the same physical device. Optionally, the radio communication module 6 can also be adapted to connect independently to the cellular network for communication with the access control server. Using the radio communication module 6, the key device 1 can communicate with an access control server as explained above. In one embodiment, the radio communication module 6 is also used to communicate with the lock device.

A clock 4 is provided as part of the key device 1 and can be used to enforce the validity times.

A battery 18 is provided to power all electrical components of the key device and also to power lock devices as explained above. The battery 18 can be a rechargeable battery or an exchangeable disposable battery.

The key device 1 is optionally provided with a user interface 7, e.g. comprising as a push button, one or more light emitting diodes (LEDs) or even a display.

Other components of the key device 1 are omitted in order not to obscure the concepts presented herein.

Optionally, the key device 1 comprises a mechanical interface 13 for mechanically manoeuvring a lock device 20 upon successful access control. The connector 12 is provided with electrical insulation 14 from the mechanical interface 13, to allow two independent galvanic contact terminals with a lock device.

In one embodiment, the key device does not comprise the mechanical interface for mechanically manoeuvring the lock device, whereby the key device is implemented using a fob or even as part of a mobile phone/smart phone. In such an embodiment, the key device is used to unlock the lock device, after which the user can open the door (or similar) without using the key device, e.g. using a handle or electrical door opener.

In one embodiment, the key device is implemented in a host device being a mobile phone or smart phone. In such a case, some of the components of FIG. 3 are part of the host device and used by the host device and the key device.

Figure 4:
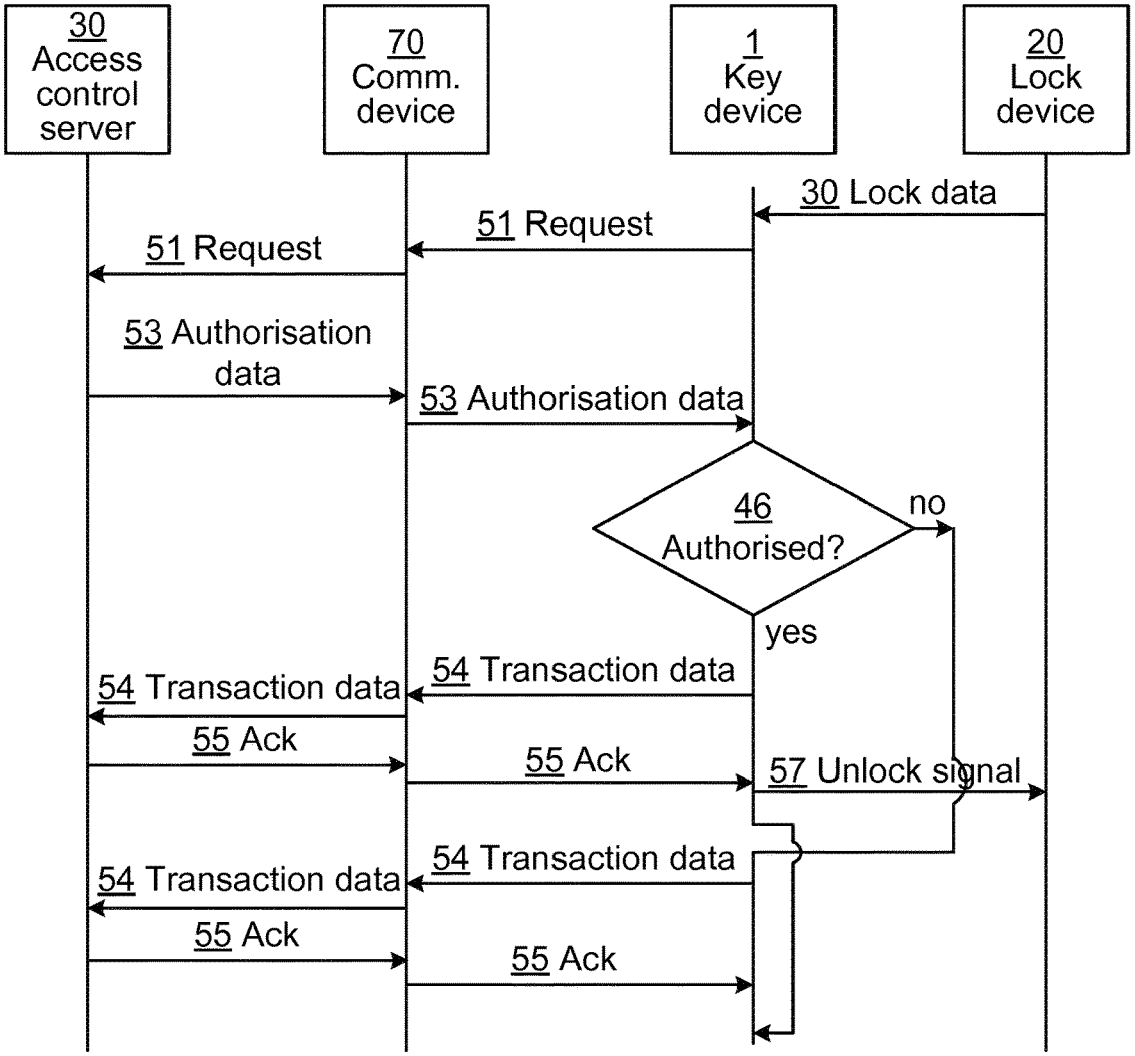
FIG. 4 is a sequence diagram illustrating authentication of a user for access to a physical space using devices shown in FIG. 1.

FIG. 4 is a sequence diagram illustrating authentication of a user for access to a physical space using devices shown in FIG. 1. The lock devices 20*a-b* from FIG. 1 are here represented by a single lock device 20.

Prior to this sequence starting, the key device 1 and the lock device 20 are brought in communication with each other, e.g. by inserting the key device 1 in the lock device 20.

Once in communication, the lock device 20 and the key device 1 exchange data with each other. For instance, the lock device 20 sends lock data 50 associated with the lock device 20 to the key device 1. This can e.g. comprise a lock identifier and/or an indicator whether new authorisation data is mandated, i.e. online access control. Optionally, a group identifier is also sent from the lock device 20 to the key device 1. The group identifier can e.g. represent a building or section of a building that the lock device 20 belongs to and for which access control is conveniently grouped with other lock devices which should share the same access level.

The key device 1 then transmits a request 51 for authorisation data to the communication device 70 over a short range radio link. The request 51 comprises at least a key identifier and optionally a lock identifier. The communication device 70 forwards the request 51 to the access control server 30, optionally after first reformatting the request 51 to be suitable for transmission to the access control server 30.

Once received, server responds with authorisation data 53 to the communication device 70. The authorisation data can e.g. be an access list comprising one or more lock devices that the key device is authorised to open. Alternatively, when the request 51 comprises both the key identifier and the lock identifier, the access control server 30 can perform the access control based on the key identifier and the lock identifier, resulting in an access indicator being either granted access or denied access. In such a case, the authorisation data 53 can comprise the access indicator.

The communication device 70 forwards the authorisation data 53 to the key device 1, optionally after first reformatting the authorisation data 53 to be suitable for transmission to the key device 1.

The key device 1 then determines 46 whether the key device 1 is authorised to unlock the lock device 20 or not, as explained in more detail below.

If the authorisation 46 is positive, the key device 1 optionally sends transaction data 54 to the communication device 70. The transaction data 54 comprises an indication of the granted access, optionally with a time stamp.

The communication device 70 forwards the transaction data 54 to the access control server 30, optionally after first reformatting the transaction data 54 to be suitable for transmission to the access control server 30. The access control server 30 optionally responds with an acknowledgement 55 (of the received transaction data) to the communication device 70, which in turn forwards the acknowledgement 55 to the key device.

The key device 1 is then ready to send an unlock signal 57 to the lock device 20, whereby the lock device is set in an unlocked state. Optionally, the unlock signal 57 is sent prior to the key device sending the transaction data 54 to the communication device 70.

If the authorisation 46 is negative, the key device 1 optionally sends transaction data 54 to the communication device 70. The transaction data 54 comprises an indication of the denied access, optionally with a time stamp.

The communication device 70 forwards the transaction data 54 to the access control server 30, optionally after first reformatting the transaction data 54 to be suitable for transmission to the access control server 30. The access control server 30 optionally responds with an acknowledgement 55 (of the received transaction data) to the communication device 70, which in turn forwards the acknowledgement 55 to the key device.

In one embodiment, the key device 1 is implemented in a host device being the communication device 70 (e.g. mobile phone or smart phone). In such an embodiment, the gateway function of the communication device in FIG. 4 is performed internally within the one device comprising the communication device 70 and the key device 1.

Figure 5:
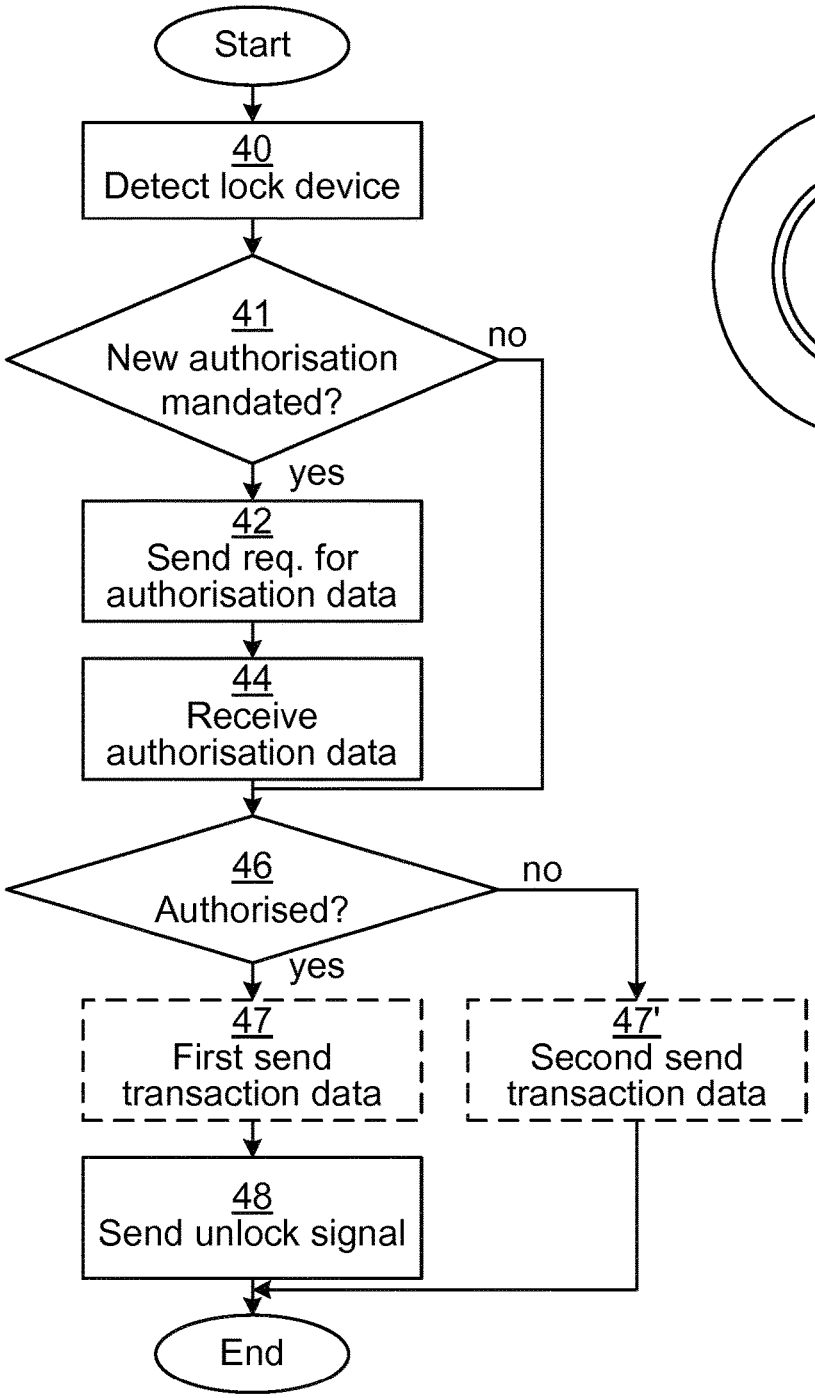
FIG. 5 is a flow chart illustrating a method for authenticating a user for access to a physical space, performed in the key device of FIG. 1.

FIG. 5 is a flow chart illustrating a method for authenticating a user for access to a physical space, performed in the key device of FIG. 1. The flow chart corresponds roughly to the activities and communication of the key device 1 of FIG. 4.

In a detect lock device step 40, the presence of a lock device is detected. This can e.g. occur when a user inserts the key device in the lock device as described above.

In a conditional new authorisation mandated step 41, the key device determines whether new authorisation data is mandated. The new authorisation data would then be obtained from the access control server for determination whether the key device is authorised to open the lock device. By mandating such new authorisation data, great security is achieved, since any changes in authorisation at a central level (at the access control server) are applied prior to any unlocking.

This determination can e.g. be based on data received from the lock device in the detect lock device step 40 indicating that new authorisation data is mandated. For instance, lock devices (e.g. 20*a* of FIG. 1) for external doors of a building may be configured to mandate new authorisation data while lock devices (e.g. 20*b* of FIG. 1) for internal doors may not need to mandate new authorisation data. One reason for this can be that external security is of greater importance to ensure that no users with an unauthorised key device enter the outer shell of the controlled physical space. Another reason is that cellular coverage for a communication device may be worse or even non-existent deep inside a building, preventing communication between the key device and the access control server. In such a solution, the validity times of access lists can be set relatively short, since a new access list is retrieved each time a user gains access for a lock device of an external door.

Alternatively or additionally, this determination can be based on a validity time of previously obtained authorisation data, such that when the authorisation data is not valid any more, new authorisation data is mandated, regardless of what is communicated between the key device and the lock device.

It is to be noted that in an embodiment where new authorisation data is mandated for all lock devices, this is equivalent to an online system, whereby there is no need for black lists (indicating key devices which are barred from all access, e.g. due to being lost or stolen).

If the result of this step is yes, the method proceeds to a send request for authorisation data step 42. Otherwise, the method proceeds to a conditional authorised step 46.

In the send request for authorisation data step 42, the key device sends a request for authorisation data to the access control server. The request comprises an identifier of the key device. Optionally, the request also comprises an identifier of the lock device.

In a receive authorisation data step 44, the key device receives authorisation data from the access control server. The authorisation data can comprise an access list indicating one or more lock devices that the key device is authorised to open. Alternatively, the authorisation data comprises an access indicator of whether access is granted or denied.

In the conditional authorised step 46, the key device determines whether the key device is authorised to open the lock device. This determination is based on the authorisation data received in step 44. When the authorisation data comprises the access list, this determination is based on the access list, such that access is only granted when an identifier of the lock device or a group identifier (that the lock device belongs to) is on the access list. When the authorisation data comprises an access indicator being either granted access or denied access as determined by the access control server, this step simply follows access indicator.

In the situation that new authorisation data is not required from the access control server (as determined in the optional conditional new authorisation mandated step 41—no), the determining whether the key device is authorised to open the lock device can be based on an access list stored in the key device. As explained above, the access list indicates one or more lock devices or group identifiers (that the lock device belongs to) that the key device is authorised to open. The stored access list has previously been received from the access control server, e.g. when the key device was used to open a lock for which new authorisation data was mandated.

When the key device is authorised, the method proceeds to an optional first send transaction data step 47, or when this step is not performed, to a send unlock signal step 48.

When the key device is not authorised, the method proceeds to an optional second send transaction data step 47', or when this step is not performed, the method ends.

In the optional first send authorisation data step 47, the key device sends transaction data to the access control server. The transaction data comprises an indication of the result of the conditional authorised step 46. The equivalent optional second send authorisation step 47' is also performed if the result of the conditional authorised step 46 is no.

The first send transaction data step 47 is optionally performed prior to the send unlock signal step 48 (as shown). In this way, the delivery of transaction data to the access control server is more reliable, since if the first send transaction data step 47 is performed after the send unlock signal step 48, the communication is not as secure, since the user may turn off the communication device or radio conditions may deteriorate once the user into the closed physical space (e.g. inside a building with concrete walls). However, the alternative is also possible, i.e. that the send unlock signal step 48 is performed prior to the first send transaction data step 47.

In a send unlock signal step 48, the key device sends an unlock signal to the lock device when the key device is allowed to open the lock device.

While cellular communication systems of the future may be better in terms of latency, it is recognised that current implementations of this method do introduce some latency when new authorisation data is mandated. However, this latency is acceptable when weighed against the advantages of improved security. Moreover, lock devices (see 20*b* of FIG. 1) for internal doors can be configured to not require online access, whereby such communication latency can be avoided for internal lock devices.

By performing the authorisation determination in the key device, a system where communication with the access control server is mandated (at least part of the time) is made more efficient. If authorisation determination were to be performed e.g. in the lock device, even more latency and complexity is introduced compared to the solution presented here. Moreover, performing the authorisation determination is suited for a mixed environment where some lock devices require new authorisation data (i.e. an online check) and some lock devices can be opened without such an online check.

Figure 6:
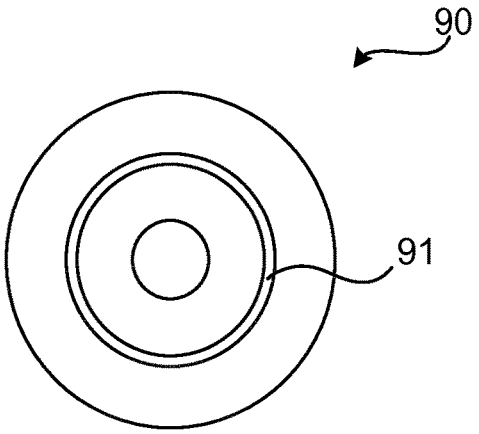
FIG. 6 shows one example of a computer program product comprising computer readable means.

FIG. 6 shows one example of a computer program product comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 66 of FIG. 3. While the computer program 91 is here schematically shown as a track on the depicted optical disk, the computer program can be stored in any way which is suitable for the computer program product, such as a removable solid state memory, e.g. a Universal Serial Bus (USB) drive.

Here now follows a list of embodiments from another perspective, enumerated with roman numerals.

i. A method performed in a key device for authenticating a user for access to a physical space, the method comprising the steps of:

detecting the presence of a lock device;

sending a request for authorisation data to an access control server, the request comprising an identifier of the key device;

receiving authorisation data from the access control server;

determining whether the key device is authorised to open the lock device; and sending an unlock signal to the lock device when the key device is allowed to open the lock device.

ii. The method according to embodiment i, wherein in the step of receiving, the authorisation data comprises an access list indicating one or more lock devices that the key device is authorised to open; and wherein the step of determining whether the key device is authorised is based on the access list.

iii. The method according to any one of the preceding embodiments, further comprising the step of:

determining whether new authorisation data is mandated from the access control server for determination whether the key device is authorised to open the lock device; and wherein the steps of sending a request, and receiving authorisation data do not need to be performed when no new authorisation data is required from the access control server to determine whether the key device is authorised to open the lock device.

iv. The method according to embodiment iii, wherein, when new authorisation data is not required from the access control server to determine whether the key device is authorised to open the lock device, the determining whether the key device is authorised to open the lock device is based on an access list stored in the key device, the access list indicating one or more lock devices that the key device is authorised to open.

v. The method according to any one of the preceding embodiments, wherein in the step of sending a request, the request comprises an identifier of the lock device.

vi. The method according to any one of the preceding embodiments, further comprising the step of:

sending transaction data to the access control server comprising an indication of the result of the step of determining whether the key device is authorised.

vii. The method according to embodiment vi, wherein the step of sending transaction data is performed prior to the step of sending an unlock signal.

viii. A key device arranged to authenticate a user for access to a physical space, the key device comprising:

a processor; and a memory storing instructions that, when executed by the processor, causes the key device to:

detect the presence of a lock device;

send a request for authorisation data to an access control server, the request comprising an identifier of the key device;

receive authorisation data from the access control server;

determine whether the key device is authorised to open the lock device; and send an unlock signal to the lock device when the key device is allowed to open the lock device.

ix. The key device according to embodiment viii, wherein the authorisation data comprises an access list indicating one or more lock devices that the key device is authorised to open; and wherein the instructions to determine whether the key device is authorised comprise instructions that, when executed by the processor, causes the key device to perform the determination based on the access list.

x. The key device according to any one of embodiments viii to ix, further comprising instructions that, when executed by the processor, causes the key device to: determine whether new authorisation data is mandated from the access control server for determination whether the key device is authorised to open the lock device; and to not necessarily perform the instructions to send a request, receive authorisation data when no new authorisation data is required from the access control server to determine whether the key device is authorised to open the lock device.

xi. The key device according to embodiment x, further comprising instructions that, when executed by the processor, causes the key device to: when new authorisation data is not required from the access control server to determine whether the key device is authorised to open the lock device, determine whether the key device is authorised to open the lock device based on an access list stored in the key device, the access list indicating one or more lock devices that the key device is authorised to open.

xii. The key device according to any one of embodiments viii to xi, wherein the request comprises an identifier of the lock device.

xiii. The key device according to any one of embodiments viii to xii, further comprising instructions that, when executed by the processor, causes the key device to send transaction data to the access control server comprising an indication of the result of the instructions to determine whether the key device is authorised.

xiv. The key device according to embodiment xiii, further comprising instructions that, when executed by the processor, causes the key device to perform the instructions to send transaction data prior to the instructions to send an unlock signal.

xv. A computer program for authenticating a user for access to a physical space, the computer program comprising computer program code which, when run on a key device causes the key device to:

detect the presence of a lock device;

send a request for authorisation data to an access control server, the request comprising an identifier of the key device;

receive authorisation data from the access control server;

determine whether the key device is authorised to open the lock device; and send an unlock signal to the lock device when the key device is allowed to open the lock device.

xvi. A computer program product comprising a computer program according to embodiment xv and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method performed in a key device for authenticating a user for access to a physical space, the method comprising:

detecting the presence of a lock device;

receiving data from the lock device that is stored in memory of the lock device, wherein the data received from the lock device comprises a lock identifier and an indicator whether the lock device requires all key devices in communication with the lock device to retrieve new authorisation data;

determining, based on the indicator received from the lock device, whether new authorisation data is mandated from an access control server for determination whether the key device is authorised to open the lock device;

sending, when new authorisation data is mandated from the access control server, a request for authorisation data to the access control server, the request comprising an identifier of the key device;

receiving authorisation data from the access control server when new authorisation data is mandated from the access control server, wherein the authorisation data received from the access control server comprises an access indicator of whether access is granted or denied;

determining whether the key device is authorised to open the lock device, which comprises following the access indicator, as determined by the access control server;

sending transaction data to the access control server comprising an indication of the result of the step of determining whether the key device is authorised, and sending an unlock signal to the lock device when the key device is allowed to open the lock device, wherein the step of sending transaction data to the access control server is performed prior to the step of sending an unlock signal;

wherein the steps of sending a request and receiving authorisation are only performed when new authorisation data is mandated from the access control server to determine whether the key device is authorised to open the lock device.

2. The method according to claim 1, wherein in the step of receiving authorisation data from the access control server, the authorisation data comprises an access list indicating one or more lock devices that the key device is authorised to open; wherein the data stored in memory of the lock device further comprises a group identifier representing a building or building section that the lock device belongs to; and wherein the step of determining whether the key device is authorised is based on the access list.

3. The method according to claim 1, wherein an access list is referenced that indicates that the key device is authorised to open the lock device.

4. The method according to claim 1, wherein in the step of sending a request, the request comprises the lock identifier of the lock device.

5. A key device arranged to authenticate a user for access to a physical space, the key device comprising:

a processor; and a memory storing instructions that, when executed by the processor, causes the key device to:

detect the presence of a lock device;

receive data from the lock device that is stored in memory of the lock device, wherein the data received from the lock device comprises a lock identifier and an indicator whether the lock device requires all key devices in communication with the lock device to retrieve new authorisation data;

determine, based on the indicator received from the lock device, whether new authorisation data is mandated from an access control server for determination whether the key device is authorised to open the lock device;

send, when new authorisation data is mandated from the access control server, a request for authorisation data to the access control server, the request comprising an identifier of the key device;

receive authorisation data from the access control server when new authorisation data is mandated from the access control server, wherein the authorisation data received from the access control server comprises an access indicator of whether access is granted or denied;

determine whether the key device is authorised to open the lock device, which comprises following the access indicator, as determined by the access control server;

send transaction data to the access control server comprising an indication of the result of the step of determining whether the key device is authorised; and send an unlock signal to the lock device when the key device is allowed to open the lock device, wherein the transaction data is sent to the access control server prior to sending an unlock signal;

wherein the instructions to send a request and receive authorisation are only performed when new authorisation data is mandated from the access control server to determine whether the key device is authorised to open the lock device.

6. The key device according to claim 5, wherein the authorisation data comprises an access list indicating one or more lock devices that the key device is authorised to open; and wherein the instructions to determine whether the key device is authorised comprise instructions that, when executed by the processor, causes the key device to perform the determination based on the access list.

7. The key device according to claim 5, wherein an access list is stored in the key device that identifies one or more lock devices that the key device is authorized to open.

8. The key device according to claim 5, wherein the data stored in the memory of the lock device and provided to the key device further comprises a group identifier representing a building or building section that the lock device belongs to.

9. A non-transitory computer-readable medium comprising computer program instructions stored thereon for authenticating a user for access to a physical space, the computer program instructions comprising computer program code which, when run on a key device causes the key device to:

detect the presence of a lock device;

receive data from the lock device that is stored in memory of the lock device, wherein the data received from the lock device comprises a lock identifier and an indicator whether the lock device requires all key devices in communication with the lock device to retrieve new authorisation data;

determine, based on the indicator received from the lock device, whether new authorisation data is mandated from an access control server for determination whether the key device is authorised to open the lock device;

send, when new authorisation data is mandated from the access control server, a request for authorisation data to the access control server, the request comprising an identifier of the key device;

receive authorisation data from the access control server when new authorisation data is mandated from the access control server, wherein the authorisation data received from the access control server comprises an access indicator of whether access is granted or denied;

determine whether the key device is authorised to open the lock device, which comprises following the access indicator, as determined by the access control server;

send transaction data to the access control server comprising an indication of the result of the step of determining whether the key device is authorised, and send an unlock signal to the lock device when the key device is allowed to open the lock device, wherein the transaction data is sent to the access control server prior to sending an unlock signal;

wherein the computer code to send a request and receive authorization is only performed when new authorisation data is mandated from the access control server to determine whether the key device is authorised to open the lock device.

10. A computer program product comprising the non-transitory computer-readable medium according to claim 9.

* * * * *